US007654528B2

(12) United States Patent
Abe et al.

(10) Patent No.: US 7,654,528 B2
(45) Date of Patent: Feb. 2, 2010

(54) SHEET FEED MECHANISM

(75) Inventors: Yoshibumi Abe, Fukushima-ken (JP); Zenko Motoki, Fukushima-ken (JP); Takefumi Osaka, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 497 days.

(21) Appl. No.: 11/460,192

(22) Filed: Jul. 26, 2006

(65) Prior Publication Data

US 2007/0035085 A1 Feb. 15, 2007

(30) Foreign Application Priority Data

Aug. 10, 2005 (JP) ..... 2005-231823

(51) Int. Cl.
*B65H 5/02* (2006.01)

(52) U.S. Cl. ..... 271/274

(58) Field of Classification Search ..... 271/274, 271/184, 225, 902

See application file for complete search history.

(56) References Cited

U.S. PATENT DOCUMENTS 3,618,934 A * 11/1971 Germuska ..... 271/274
5,101,284 A * 3/1992 Tanabe ..... 358/461
6,343,787 B1 * 2/2002 Kato et al. ..... 271/274
6,505,833 B2 * 1/2003 Kato et al. ..... 271/272
6,682,069 B2 * 1/2004 Shibabuki ..... 271/274
6,816,229 B2 * 11/2004 Oono ..... 355/18
7,252,287 B2 * 8/2007 Tsutoh ..... 271/274
7,427,065 B2 * 9/2008 Maruyama ..... 271/273
2005/0184455 A1 * 8/2005 Youn ..... 271/274

FOREIGN PATENT DOCUMENTS

JP 2000-321680 11/2000

* cited by examiner

*Primary Examiner*—Patrick H Mackey
*Assistant Examiner*—Michael C McCullough
(74) *Attorney, Agent, or Firm*—Brinks Hofer Gilson & Lione

(57) ABSTRACT

A sheet feed mechanism is provided. In a sheet feed mechanism, a first sheet feeding device includes a first sheet feed roller and a first pressure contact roller that can be in pressure contact with the first sheet feed roller. The sheet feed mechanism further includes a recording sheet, which can be conveyed downstream by the rotation of the first sheet feed roller while being held in pressure contact between the first sheet feed roller and the first pressure contact roller. The first pressure contact roller is connected to a pressure contact release mechanism that can release the pressure contact of the first pressure contact roller with the first sheet feed roller. The pressure contact release mechanism is provided near the center in an axial direction of the first pressure contact roller.

9 Claims, 4 Drawing Sheets

SHEET FEED MECHANISM

This application claims the benefit of the Japanese patent Application No. 2005-231823 filed on Aug. 10, 2005, which is hereby incorporated by reference.

BACKGROUND

1. Field

A sheet feed mechanism is provided.

2. Related Art

As illustrated in FIG. 3, a conventional sheet feed mechanism 30 includes a rotatable pressure contact roller 32 and a sheet feed roller 31 that is driven to rotate. The sheet feed roller 31 and the pressure contact roller 32, which are each formed into a longitudinal shape, can nip a recording sheet 33 in pressure contact therebetween. The recording sheet 33 is a heavy paper, such as a photographic paper. When the sheet feed roller 31 is rotated in a clockwise direction (i.e., a direction indicated by an arrow), the recording sheet 33 can be conveyed downward in the figure.

One end in a longitudinal direction of the pressure contact roller 32 is provided with an actuating arm 34 that serves as a pressure contact release mechanism for releasing the pressure contact of the pressure contact roller 32 with the sheet feed roller 31.

In the actuating arm 34, a spindle 34*a* located at a lower position in the figure serves as a fulcrum, and an upper portion of the actuating arm 34 in the figure can be rotated. An approximately intermediate portion of the actuating arm 34 is resiliently biased by a first resilient member 35 that is formed by a coil spring. Therefore, the pressure contact roller 32 is caused to be in pressure contact with the sheet feed roller 31 due to biasing force of the first resilient member 35.

A motor 36 formed by a stepping motor is provided as a member for driving to rotate the actuating arm 34. A crank arm 37 is axially fastened to a drive shaft 36*a* of the motor 36, and a second resilient member 38 formed by a coil spring is connected between a leading end of the crank arm 37 and the actuating arm 34.

In the thus configured conventional sheet feed mechanism 30, the motor 36 is driven to rotate by a predetermined angle, with the recording sheet 33 fed between the sheet feed roller 31 and the pressure contact roller 32. Thereby, as illustrated in FIG. 3, the crank arm 37 is moved to an approximately horizontal position in the left-pointing direction in the figure.

The biasing force of the first resilient member 35 becomes larger than the biasing force of the second resilient member 38, and the pressure contact roller 32 nips the recording sheet 33 in pressure contact with the sheet feed roller 31.

The sheet feed roller 31 is driven to rotate in the clockwise direction, and the recording sheet 33 is conveyed downward in the figure.

To release the pressure contact of the pressure contact roller 32 with the sheet feed roller 31 in accordance with need, the crank arm 37 drives to rotate the motor 36, which has been in an approximately horizontal position in the left-pointing direction in the figure, by an approximately 180 degrees. Thereby, the crank arm 37 is moved to an approximately horizontal position in the right-pointing direction in the figure.

The resilient force of the second resilient member 38 becomes larger than the resilient force of the first resilient member 35, and the pressure contact roller 32 oscillates in the right direction in the figure, with the spindle 34*a* of the actuating arm 34 functioning as the fulcrum. The pressure contact roller 32 is separated from the sheet feed roller 31. The conventional sheet feed mechanism of this type is described in Japanese Unexamined Patent Application Publication No. 2000-321680, for example.

In the conventional sheet feed mechanism 30 as described above, however, the actuating arm 34 attached to the one end of the longitudinally-shaped pressure contact roller 32 is rotated to cause the pressure contact roller 32 to contact and separate from the sheet feed roller 31. Therefore, the pressure contact roller 32 tends to be obliquely positioned, and it is difficult to perform and release the pressure contact of the pressure contact roller 32 parallel to the recording sheet 33.

A deviation in timing occurs in performing and releasing the pressure contact of the pressure contact roller 32 with respect to the recording sheet 33 in the longitudinal direction. This may cause a conveyance skew or the like in the recording sheet 33 in a conveyance process, and thus may cause such phenomena as oblique conveyance (i.e., oblique passage) of the recording sheet 33.

SUMMARY

According to a first aspect, a sheet feed mechanism includes a sheet feeding device, a recording sheet, and a printing device. The sheet feeding device includes a sheet feed roller, and a pressure contact roller capable of being in pressure contact with the sheet feed roller. The recording sheet is held in pressure contact between the sheet feed roller and the pressure contact roller, and is conveyed by rotation of the sheet feed roller. The printing device prints a desired image on the recording sheet. The sheet feed roller can be driven to rotate, and the pressure contact roller can hold the recording sheet in pressure contact between the pressure contact roller and the sheet feed roller. The pressure contact roller is connected to a pressure contact release mechanism which can release the pressure contact of the pressure contact roller with the sheet feed roller, and which is provided near the center in an axial direction of the pressure contact roller.

According to a second aspect, the sheet feeding device includes a drive shaft extending parallel to the axial direction of the pressure contact roller, and a drive source that drives to rotate the drive shaft by a predetermined angle. The pressure contact release mechanism includes a connecting gear axially fastened to the drive source via a connecting shaft, and a drive gear meshed with the connecting gear and axially fastened to an approximately center of the drive shaft. When the connecting shaft is driven to rotate by the drive source, the drive shaft may be rotated by a predetermined angle via the connecting gear and the drive gear to enable release of the pressure contact of the pressure contact roller with the sheet feed roller.

According to a third aspect, the sheet feeding device includes a pair of roller support members for rotatably supporting opposite ends of a rotation shaft of the pressure contact roller. Each of the pair of roller support members have one end formed with a roller support portion capable of rotatably supporting the rotation shaft of the pressure contact roller, and the other end resiliently biased by a resilient member. Through rotation of the drive shaft by a predetermined angle, the pressure contact release mechanism causes the roller support member to rotate against biasing force of the resilient member, with a rotation support portion of the roller support member supported by a printer body and functioning as a fulcrum, and causes the pressure contact roller to separate from the sheet feed roller by a predetermined distance.

According to a fourth aspect, the sheet feeding device includes first and second sheet feeding devices. The first sheet feeding device is provided at a downstream position of the printing device in a direction of conveying the recording sheet in a printing process, and includes a first sheet feed roller and a first pressure contact roller. The second sheet feeding device is provided at an upstream position of the printing device in the direction of conveying the recording sheet, and includes a second sheet feed roller and a second pressure contact roller. The pressure contact release mechanism is provided to either one of the first and second sheet feeding devices. Opposite ends in an axial direction of the drive shaft may support first drive links which can drive to rotate first roller support members of the first sheet feeding device, and second drive links which can drive to rotate second roller support members of the second sheet feeding device.

According to a fifth aspect, first and second cam members are axially fastened to opposite near-end portions in the axial direction of the drive shaft. The first cam members are rotatably fitted in corresponding first cam holes formed on the first drive links. The second cam members are rotatably fitted in corresponding second cam holes formed on the second drive links.

According to a sixth aspect, each of the first drive links have one end formed with the first cam hole. The other end is formed with a first link support portion capable of rotatably supporting the other end of the corresponding first roller support member. When the drive shaft is driven to rotate by a predetermined angle, the first cam members are rotated in the first cam holes, and the first roller support members are rotated via the first drive links, with first rotation support portions of the first roller support members functioning as fulcrums, so that the first pressure contact roller can contact and separate from the first sheet feed roller.

According to a seventh aspect, each of the second drive links have one end formed with the second cam hole, and the other end formed with a second link support portion capable of rotatably supporting the other end of the corresponding second roller support member. When the drive shaft is driven to rotate by a predetermined angle, the second cam members are rotated in the second cam holes, and the second roller support members are rotated via the second drive links, with second rotation support portions of the second roller support members functioning as fulcrums, so that the second pressure contact roller can contact and separate from the second sheet feed roller.

According to an eighth aspect of the present invention, when the recording sheet is conveyed downstream while being nipped in pressure contact between the second sheet feed roller and the second pressure contact roller located at upstream positions of the printing device, the pressure contact of the first pressure contact roller with the first sheet feed roller may be released. Before a front end portion of the recording sheet that is being conveyed downstream passes between the first pressure contact roller and the first sheet feed roller that has been released from the pressure contact, and before the pressure contact of the second sheet feed roller and the second pressure contact roller with the recording sheet is released, the drive shaft is driven to rotate for rotating the second roller support members via the second drive links and releasing the pressure contact of the second pressure contact roller with the recording sheet which is being conveyed. The first roller support members are rotated via the first drive links, and the recording sheet which is being conveyed is conveyed downstream, with the first pressure contact roller being in pressure contact with the first sheet feed roller.

According to a ninth aspect, when the first pressure contact roller causes the recording sheet to be in pressure contact with the first sheet feed roller, and when a rear end portion of the recording sheet in a printing process is released from the printing device, the first and second sheet feed rollers is driven to rotate in a reverse direction to feed the recording sheet back. Before the front end portion of the recording sheet that is being fed back passes between the second pressure contact roller and the second sheet feed roller that is being released from the pressure contact. Before the pressure contact of the first sheet feed roller and the first pressure contact roller with the recording sheet is released, the drive shaft may be driven to rotate that rotates the first roller support members via the first drive links and releasing the pressure contact of the first pressure contact roller with the recording sheet which is being fed back. The second roller support members may be rotated via the second drive links, and the recording sheet that is being fed back may be conveyed upstream, with the second pressure contact roller being in pressure contact with the second sheet feed roller.

In the sheet feed mechanism according to the above aspects, the sheet feeding device includes the sheet feed roller that can be driven to rotate, and the pressure contact roller that can hold the recording sheet in pressure contact between the sheet feed roller. The pressure contact roller is connected to the pressure contact release mechanism that can release the pressure contact of the pressure contact roller with the sheet feed roller. The pressure contact release mechanism is provided near the center in the axial direction of the pressure contact roller. The pressure contact of the pressure contact roller with the recording sheet can be performed and released, with the axial direction of the pressure contact roller kept parallel to the recording sheet. A conveyance skew or the like does not occur in the recording sheet in a conveyance process, and occurrence of such undesirable phenomenon as oblique passage of the recording sheet can be prevented.

Accordingly, high quality image printing can be performed on the recording sheet.

The pressure contact release mechanism includes the connecting gear, and the drive gear axially fastened to the approximately center of the drive shaft that is meshed with the connecting gear. When the connecting shaft is driven to rotate by the drive source, the drive shaft is rotated by a predetermined angle via the connecting gear and the drive gear to release the pressure contact of the pressure contact roller with the sheet feed roller. The pressure contact release mechanism can be provided in an area not interrupted by the sheet feed roller, and the degree of design freedom of the sheet feed mechanism can be increased.

In the pressure contact release mechanism, when the drive shaft is rotated by a predetermined angle, the roller support members are rotated against the biasing force of the resilient members, with the rotation support portions supported by the printer body functioning as the fulcrums. The pressure contact roller is separated form the sheet feed roller by a predetermined distance. With this rotation of the roller support members, therefore, the pressure contact of the pressure contact roller can be preformed and released, with the pressure contact roller kept parallel to the recording sheet. The recording sheet can be conveyed without being obliquely passed.

The pressure contact release mechanism is provided to either one of the first and second sheet feeding devices, and the opposite ends in the axial direction of the drive shaft support the first drive links capable of driving to rotate the first roller support members of the first sheet feeding device and the second drive links capable of driving to rotate the second roller support members of the second sheet feeding device. Therefore, when the drive shaft is driven to rotate by the predetermined angle, the first and second roller support members are driven to rotate, and the pressure contact of the first and second pressure contact rollers can be securely performed and released, with each of the first and second pressure contact rollers kept in a horizontal position.

The first cam members rotatably fitted in the first cam holes formed on the first drive links and second cam members rotatably fitted in the second cam holes formed on the second drive links are respectively axially fastened to the opposite near-end portions in the axial direction of the drive shaft. Therefore, when the drive shaft is driven to rotate, the first and second cam members are rotated, and the first and second drive links are moved. Thereby, the first and second roller support members can be securely rotated.

One end of each of the first drive links is formed with the first cam hole, and the other end of the first drive link is formed with the first link support portion capable of rotatably supporting the other end of the first roller support member. When the drive shaft is driven to rotate by the predetermined angle, the first cam member is rotated in the first cam hole, and the first roller support member is rotated via the first drive link, with the first rotation support portion functioning as the fulcrum. Thereby, the first pressure contact roller can contact and separate from the first sheet feed roller. Therefore, the pressure contact of the first pressure contact roller can be securely performed, with the first pressure contact roller kept parallel to the first sheet feed roller.

One end of each of the second drive links is formed with the second cam hole, and the other end of the second drive link is formed with the second link support portion capable of rotatably supporting the other end of the second roller support member. When the drive shaft is rotated by the predetermined angle, the second cam member is rotated in the second cam hole, and the second roller support member is rotated via the second drive link, with the second rotation support portion functioning as the fulcrum. The second pressure contact roller can contact and separate from the second sheet feed roller. Therefore, the pressure contact of the second pressure contact roller can be securely performed, with the second pressure contact roller kept parallel to the second sheet feed roller.

When the recording sheet, which is nipped in pressure contact between the second sheet feed roller and the second pressure contact roller located at the upstream positions of the printing device, is conveyed downstream, the pressure contact of the first pressure contact roller with the first sheet feed roller is released. Before the front end portion of the recording sheet that is being conveyed downstream passes between the first pressure contact roller and the first sheet feed roller that has been released from the pressure contact, and before the pressure contact of the second sheet feed roller and the second pressure contact roller with the recording sheet is released, the drive shaft is driven to rotate. The second roller support members are rotated via the second drive links, and the pressure contact of the second pressure contact roller with the recording sheet which is being conveyed is released. The first roller support members are rotated via the first drive links, and the recording sheet that is being conveyed is conveyed downstream, with the first pressure contact roller being in pressure contact with the first sheet feed roller. Accordingly, the recording sheet that is being conveyed downstream can be smoothly passed from the second sheet feeding device to the first sheet feeding device.

Consequently, the recording sheet can be highly accurately conveyed downstream, without causing the front end portion of the recording sheet which is being conveyed downstream to contact the first pressure contact roller.

When the rear end portion of the recording sheet which is being conveyed downward and being in a printing process is released from the printing device, the first and second sheet feed rollers are driven to rotate in the reverse direction to feed the recording sheet back. Before the front end portion of the recording sheet that is being fed back passes between the second pressure contact roller and the second sheet feed roller that is being released from the pressure contact, and before the pressure contact of the first sheet feed roller and the first pressure contact roller with the recording sheet is released, the drive shaft is driven to rotate. The first roller support members are rotated via the first drive links, and the pressure contact of the first pressure contact roller with the recording sheet that is being fed back is released.

The second roller support members are rotated via the second drive links, and the recording sheet that is being fed back is conveyed upstream, with the second pressure contact roller being in pressure contact with the second sheet feed roller. Accordingly, the recording sheet that is being fed back upstream can be smoothly passed from the first sheet feeding device to the second sheet feeding device.

Consequently, the recording sheet can be highly accurately fed back upstream, without causing the rear end portion of the recording sheet that is being fed back upstream to contact the second pressure contact roller.

DESCRIPTION OF THE PREFERRED EMBODIMENTS

Figure 1:
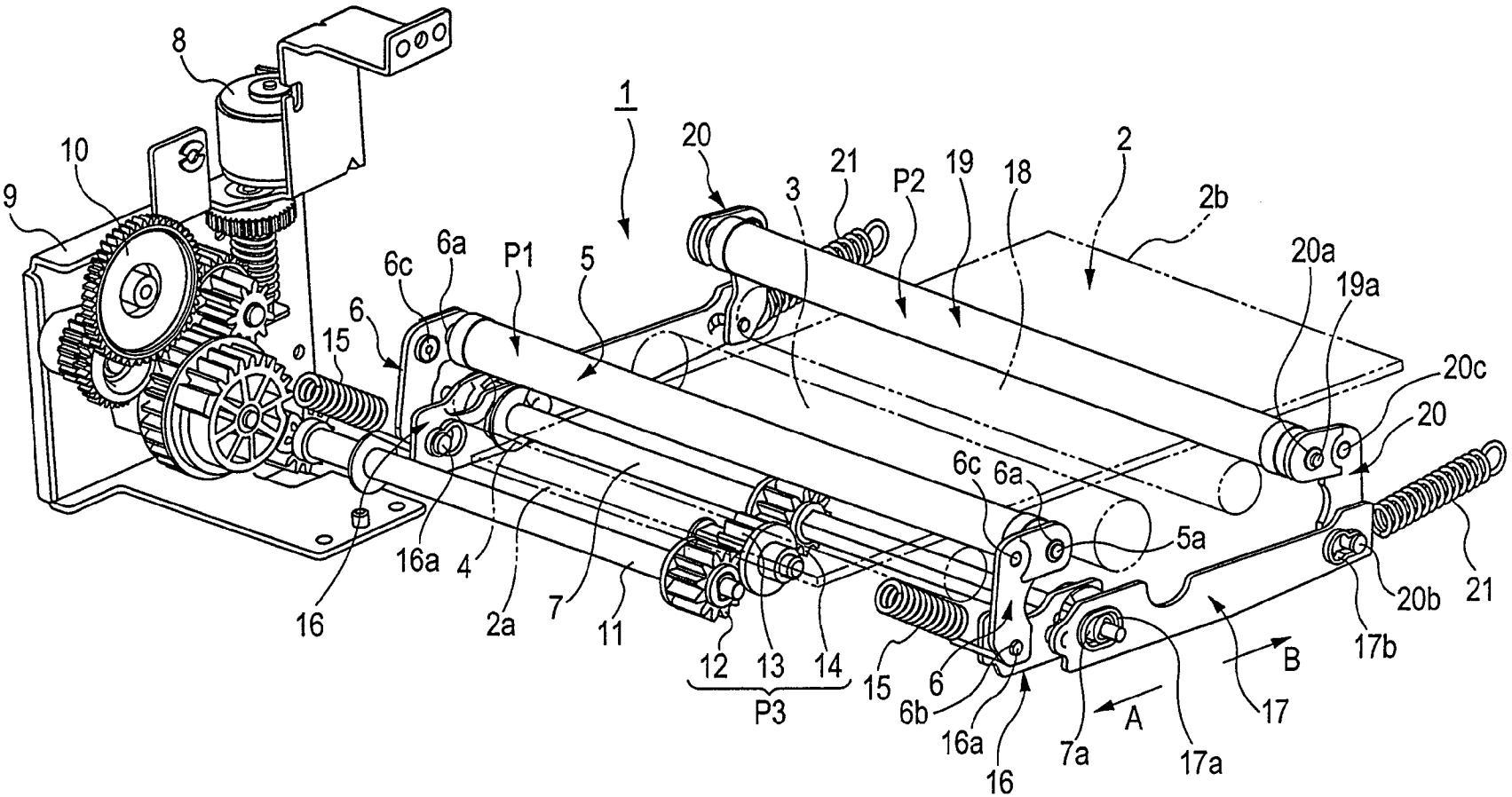
FIG. 1 is a perspective view of relevant parts of a sheet feed mechanism according to an embodiment of the present invention.
Figure 2:
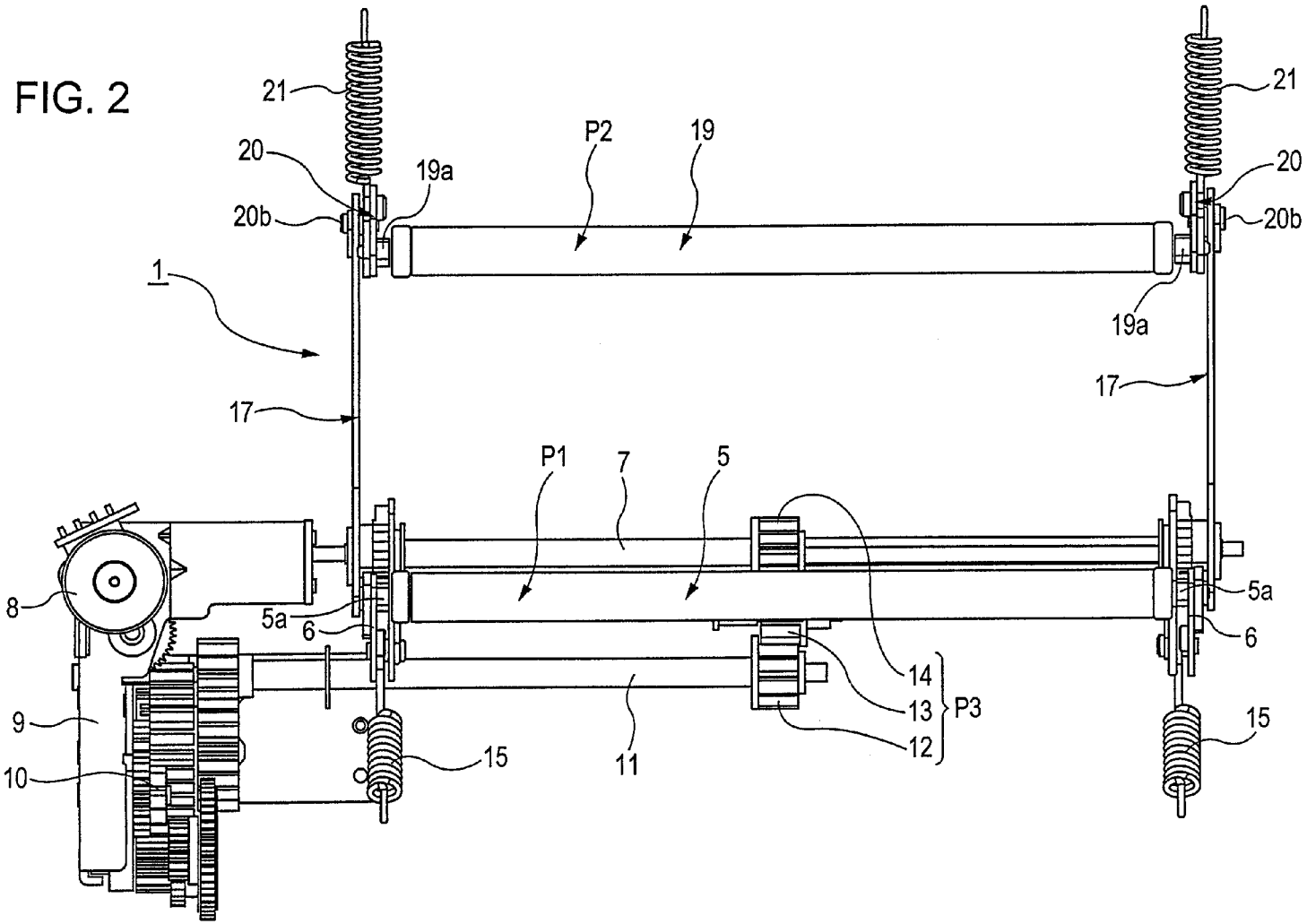
FIG. 2 is a plan view of the sheet feed mechanism illustrated in FIG. 1.
Figure 3:
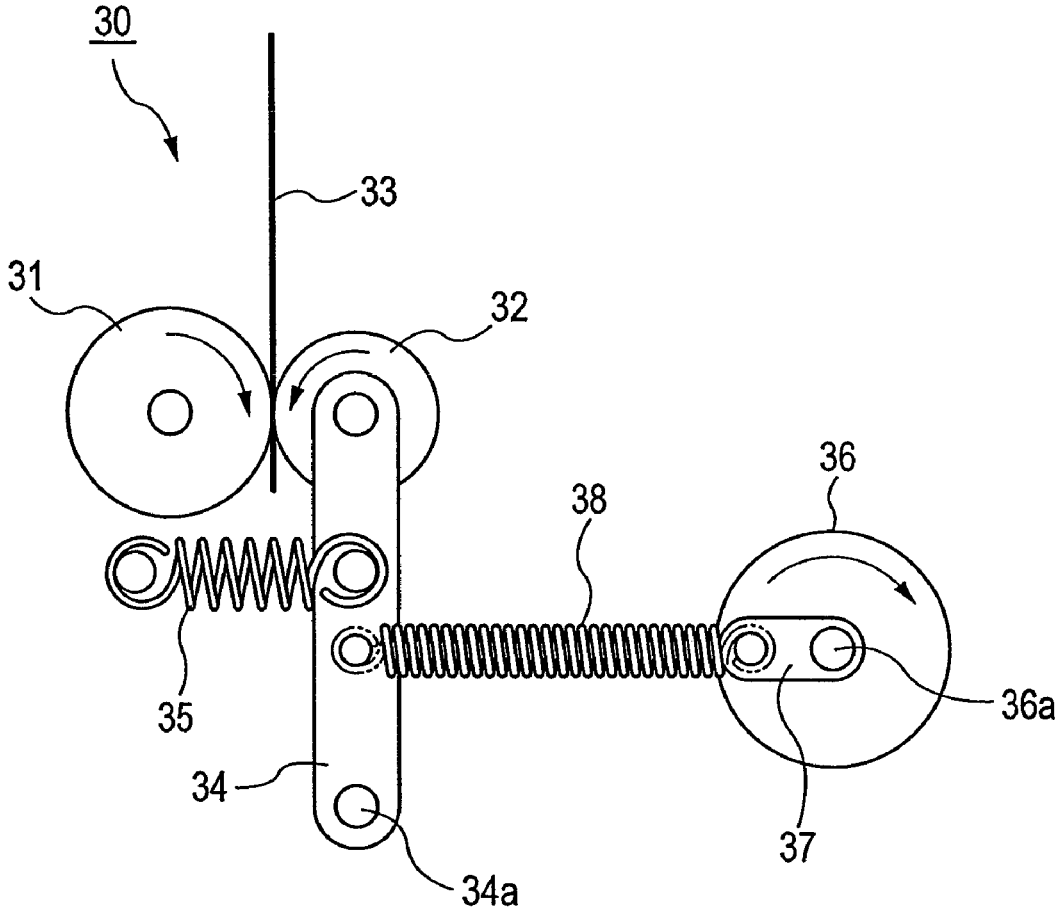
FIG. 3 PRIOR ART
FIG. 3 is a schematic view of a conventional sheet feed mechanism.

A sheet feed mechanism according to the preferred embodiments will now be described with reference to the drawings. FIG. 1 is a perspective view of relevant parts of the sheet feed mechanism according to an embodiment used in a printer. FIG. 2 is a top view of the sheet feed mechanism illustrated in FIG. 1.

The sheet feed mechanism 1 according to an embodiment includes a printing device capable of printing a desired image on a recording sheet 2 formed by a heavy paper, such as a photographic paper, on which a color image can be printed.

The printing device includes a thermal head (not illustrated), and a cylinder-shaped platen roller 3 which can be in pressure contact with the thermal head when the thermal head is lowered.

The recording sheet 2 can be conveyed back and forth in directions indicated by arrows A and B. A first sheet feeding device P1 is provided on the left side in the figure at a downstream position of the platen roller 3 in the direction of conveying the recording sheet 2 indicated by the arrow A. A second sheet feeding device P2 is provided at an upstream position of the platen roller 3 in the direction of conveying the recording sheet 2 indicated by the arrow A.

In the first sheet feeding device P1, a first sheet feed roller 4 is provided at a lower position, and a first pressure contact roller 5 is provided at an upper position. The first pressure contact roller 5 includes a rotation shaft 5*a*, which is rotatably supported at opposite ends in the axial direction thereof by a pair of approximately L-shaped first roller support members 6.

One end of each of the L-shaped first roller support members 6 is provided with a first roller support portion 6*a* that supports the rotation shaft 5*a* of the first pressure contact roller 5, and the other end of the L-shaped first roller support member 6 is provided with a support hole 6*b* that supports a first link support portion 16*a* of a later-described first drive link 16. A first rotation support portion 16*c* is formed at a corner between the first roller support portion 16*a* and the support hole 6*b* to be rotatably supported by a chassis (not illustrated) of a printer body 9.

The first roller support member 6 can be rotated, with the first rotation support portion 16*c* supported by the chassis (not illustrated) of the printer body 9 and functioning as a fulcrum.

In the first sheet feeding device P1, a drive shaft 7 is provided below the first sheet feed roller 4 to extend parallel to the axial direction of the first pressure contact roller 5. A motor 8 is provided to the printer body 9 as a drive source that drives to rotate the drive shaft 7 by a predetermined angle.

The motor 8 is provided with a connecting shaft 11. The connecting shaft 11, which is connected to gears 10 provided to the printer body 9, is rotatable in both left and right directions and is formed into a predetermined length to extend parallel to the drive shaft 7.

The first pressure contact roller 5 of the first sheet feeding device P1 is connected to a pressure contact release mechanism P3 that can release pressure contact of the first pressure contact roller 5 with the first sheet feed roller 4. The pressure contact release mechanism P3 is provided below the first sheet feed roller 4 near the center in the axial direction of the first pressure contact roller 5. The pressure contact release mechanism P3 includes a connecting gear 12 axially fastened to a leading end of the connecting shaft 11, and a drive gear 14 meshed with the connecting gear 12 via an idling gear 13. The drive gear 14 is axially fastened to the drive shaft 7 near the center thereof in the axial direction.

Both the idling gear 13 and the drive gear 14 is provided at a predetermined interval from the first sheet feed roller 4 with which the first pressure contact roller 5 can be in pressure contact.

When each of the gears 10 is driven to rotate by the motor 8 by a predetermined angle, the drive shaft 7 is rotated by a predetermined angle via the connecting gear 11, the idling gear 13, and the drive gear 14.

In each of the pair of the first roller support members 6, a first resilient member 15 formed by an extension coil spring is latched by the first link support portion 16*a* of the later-described first drive link 16, which is formed by a support pin fitted in the support hole 6*b*. The other end of the first roller support member 6 is resiliently biased constantly in the direction indicated by the arrow A.

The first pressure contact roller 5 supported by the first roller support portion 6*a* formed at the one end of each of the first roller support members 6 can be in pressure contact with the first sheet feed roller 4 due to the biasing force of each of the first resilient members 15.

When the drive shaft 7 is rotated by a predetermined angle, each of the pair of the first roller support members 6 is rotated against the biasing force of the corresponding first resilient member 15, with the rotation support portion 6*c* supported by the printer body 9 functioning as a fulcrum. The first pressure contact roller 5 in pressure contact with the first sheet feed roller 4 is separated from the first sheet feed roller 4 by a predetermined distance (i.e., a value larger than a thickness value of recording sheet 2).

Figure 4:
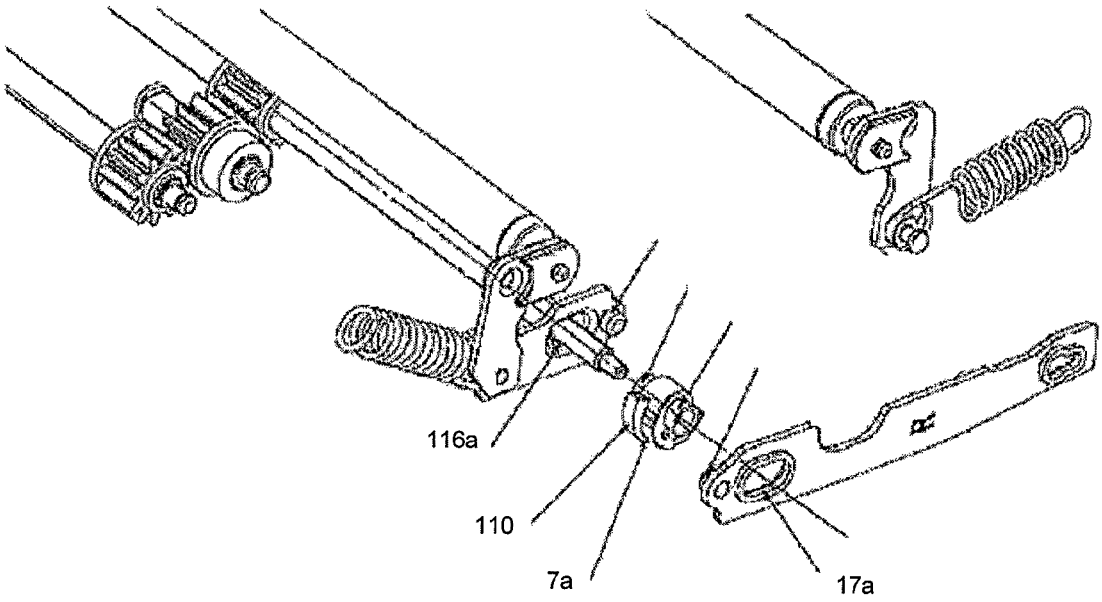
FIG. 4 is a detailed view of the first cam hole and the second cam hole of the sheet feed mechanism illustrated in FIG. 1

Opposite ends in the axial direction of the drive shaft 7 are provided with the first drive links 16, each of which is formed into an approximately rectangular plate shape and is capable of driving to rotate the corresponding first roller support member 6. One end of each of the first drive links 16 on the right side in the figure is formed with a first cam hole (116*a* in FIG. 4), while the other end of the first drive link 16 on the left side in the figure is formed with the first link support portion 16*a*, which is formed by the support pin and is fitted in and supported by the support hole 6*b* of the first roller support member 6.

The first cam members (110 in FIG. 4) axially fastened to opposite near-end portions in the axial direction of the drive shaft 7 are fitted in and supported by the first cam holes of the first drive links 16. The second cam members 7*a* are axially fastened to the drive shaft 7 at positions outside the first cam members.

One end of each of second drive links 17 on the right side in the figure is formed with an approximately pear-shaped support hole 17*b* that combines a large-diameter circle and a small-diameter circle. The other end of the horizontally-long, plate-shaped second drive link 17 on the left side in the figure is formed with a second cam hole 17*a*, and the corresponding second cam member 7*a* is fitted in and supported by the second cam hole 17*a*.

In the second sheet feeding device P2, a second sheet feed roller 18 is provided at a lower position, and a second pressure contact roller 19 is provided at an upper position. The second pressure contact roller 19 includes a rotation shaft 19*a*, which is rotatably supported at opposite ends in the axial direction thereof by a pair of approximately L-shaped second roller support members 20.

One end of each of the L-shaped second roller support members 20 is provided with a second roller support portion 20*a* that supports the rotation shaft 19*a* of the second pressure contact roller 19, and the other end of the L-shaped second roller support member 20 is provided with a second link support portion 20*b* formed by a support pin that is fitted in and supported by the support hole 17*b* of the second drive link 17. A second rotation support portion 20*c* is formed at a corner between the second roller support portion 20*a* and the second link support portion 20*b* to be rotatably supported by the chassis (not illustrated) of the printer body 9.

The second roller support member 20 can be rotated, with the second rotation support portion 20*c* supported by the chassis (not illustrated) of the printer body 9 and functioning as a fulcrum.

In each of the pair of the second roller support members 20, the second link support portion 20*b* is resiliently biased in the direction indicated by the arrow B by a second resilient member 21 formed by an extension coil spring. Therefore, the second pressure contact roller 19 supported by the second roller support portions 20*a* can be in pressure contact with the second sheet feed roller 18.

Operations of the thus configured sheet feed mechanism 1 will now be described. In the sheet feed mechanism 1 in an initial state prior to the conveyance of the recording sheet 2, the first pressure contact roller 5 of the first sheet feeding device P1 is in pressure contact with the first sheet feed roller 4, and the second pressure contact roller 19 of the second sheet feeding device P2 located at the upstream position is in pressure contact with the second sheet feed roller 18.

In the above-described initial state of the sheet feed mechanism 1 according to a preferred embodiment, the first and second sheet feed rollers 4 and 18 are driven to rotate in the counterclockwise direction, and the motor 8 is driven to rotate. This rotation of the motor 8 is transmitted to the connecting gear 12 of the pressure contact release mechanism P3 via the connecting shaft 11, and then to the drive gear 14 via the idling gear 13. Thereby, the drive gear 14 is rotated by a predetermined angle.

In conjunction with the rotation of the drive gear 14, the drive shaft 7 is also rotated by a predetermined angle, and the first cam members (110 in FIG. 4) axially fastened to the drive shaft 7 are rotated in the corresponding first cam holes (116*a* in FIG. 4) of the first drive links 16. Then, driving force of the first cam members is transmitted to the first drive links 16, and the first drive links 16 are moved in the direction indicated by the arrow B against the biasing force of the first resilient members 15.

The first roller support members 6 are rotated in the counterclockwise direction, with the respective first rotation support portions 6*c* functioning as fulcrums, and the pressure contact of the first pressure contact roller 5 with the first sheet feed roller 4 is released. The first pressure contact roller 5 is separated from the first sheet feed roller 4 in an upward direction in the figure by a distance larger than the thickness value of the recording sheet 2.

Along with the rotation of the drive shaft 7, the second cam members 7*a* axially fastened to the drive shaft 7 are idle-rotated in the second cam holes 17*a* of the respective second drive links 17. The driving force of the second cam members 7*a* is not transmitted to the second drive links 17, and thus the second drive links 17 are drawn toward the direction indicated by the arrow B due to the biasing force of the second resilient members 21.

The second roller support members 20 are rotated in the counterclockwise direction, with the respective second rotation support portions 20*c* functioning as fulcrums. The second pressure contact roller 19 is rotated downward in the figure to be in pressure contact with the second sheet feed roller 18. Thereby, the sheet feed mechanism 1 according to the preferred embodiment is in a first sheet feeding position.

In the sheet feed mechanism 1 in the first sheet feeding position, when the recording sheet 2 is conveyed downstream in the direction indicated by the arrow A from an upstream position on the right side in the figure, a front end portion 2*a* of the recording sheet 2 is nipped in pressure contact between the second sheet feed roller 18 that is being rotated in the counterclockwise direction and the second pressure contact roller 19 that is in pressure contact with the second sheet feed roller 18.

Along with the rotation of the second pressure contact roller 19, the recording sheet 2 is conveyed downstream in the direction indicated by the arrow A. When the front end portion 2*a* of the recording sheet 2 has been conveyed to reach a position on the platen roller 3 that forms the printing device, and when the head of the recording sheet 2 has been fed, the thermal head (not illustrated) is lowered, and thermal transfer of ink provided from an ink ribbon (not illustrated) is performed to the recording sheet 2, starting from the front end portion 2*a* of the recording sheet 2. Thereby, an image of the first color is printed on the recording sheet 2.

Before the recording sheet 2 in the printing process of the first-color image passes between the first sheet feed roller 4 and the first pressure contact roller 5 the pressure contact of which has been released, and before the pressure contact of the second sheet feed roller 18 and the second pressure contact roller 19 with the recording sheet 2 that is being conveyed is released, the pressure contact release mechanism P3 is driven to release the pressure contact of the second pressure contact roller 19 with the recording sheet 2.

The pressure contact release mechanism P3 is driven, and the drive shaft 7 is driven to rotate by a predetermined angle. Thereby, the second cam members 7*a* are rotated in the corresponding second cam holes 17*a*, and the driving force of the second cam members 7*a* is transmitted to the second drive links 17. The second drive links 17 are moved in the direction indicated by the arrow A against the biasing force of the second resilient members 21.

Consequently, the sheet feed mechanism 1 according to the embodiment of the present invention is in a second sheet feeding position. The second roller support members 20 are rotated in the clockwise direction, and the second pressure contact roller 19 is separated from the recording sheet 2. Thereby, the pressure contact of the second pressure contact roller 19 with the recording sheet 2 is released.

At the same time, the first cam members (110 in FIG. 4) axially fastened to the drive shaft 7 are idle-rotated in the corresponding first cam holes (116*a* in FIG. 4) of the first drive links 16. Therefore, the driving force of the first cam members is not transmitted to the first drive links 16, and the first drive links 16 are moved in the direction indicated by the arrow A due to the biasing force of the first resilient members 15.

The first roller support members 6 are rotated in the clockwise direction, with the respective rotation support portions 6*c* functioning as the fulcrums. The recording sheet 2 that is being conveyed is made in pressure contact with the first sheet feed roller 4 by the first pressure contact roller 5, and the recording sheet 2 is conveyed downstream in the direction indicated by the arrow A.

In the second sheet feeding position, when a rear end portion 2*b* of the recording sheet 2 that is being conveyed downstream in the direction indicated by the arrow A and that is in a printing process is released from the platen roller 3 (i.e., the printing device), the thermal head (not illustrated) is lifted. The recording sheet 2 is fed back upstream in the direction indicated by the arrow B in a third sheet feeding position in which the first and second sheet feed rollers 4 and 18 are driven to rotate in a reverse direction, for example, in the clockwise direction.

In the sheet feed mechanism 1 according to the embodiment of the present invention in the above third sheet feeding position, before the front end portion 2*a* of the recording sheet 2 that is being fed back upstream in the direction indicated by the arrow B passes between the second pressure contact roller 18 and the second sheet feed roller 19 that is being released from the pressure contact, and before the pressure contact of the first sheet feed roller 4 and the first pressure contact roller 5 with the recording sheet 2 is released, the pressure contact release mechanism P3 is driven to drive to rotate the drive shaft 7 by a predetermined angle.

The driving force of the first cam members (110 in FIG. 4) is transmitted to the first drive links 16, and the first drive links 16 are moved in the direction indicated by the arrow B. The first roller support members 6 are rotated in the counterclockwise direction, with the respective first rotation support portions 6*c* functioning as the fulcrums. The pressure contact of the first pressure contact roller 5 with the recording sheet 2 that is being fed back is released, and the sheet feed mechanism 1 according to the embodiment of the present invention is in a fourth sheet feeding position.

At the same time, in the fourth sheet feeding position, the driving force of the second cam members 7*a* applied to the second drive links 17 is released, and the second drive links 17 are moved in the direction indicated by the arrow B due to the biasing force of the second resilient members 21.

The second roller support members 20 are rotated in the counterclockwise direction, and the second pressure contact roller 19 is made in pressure contact with the recording sheet 2 which is being fed back in the direction indicated by the arrow B. Thereby, the recording sheet 2 is fed back upstream in the direction indicated by the arrow B.

In the fourth sheet feeding position, when the front end portion 2*a* of the recording sheet 2 that is being fed back by the second sheet feed roller 18 and the second pressure contact roller 19 reaches the position on the platen roller 3 (i.e., the printing device), the rotations of the first and second sheet feed rollers 4 and 18 are stopped. Then, the head of the recording sheet 2 is fed.

Thereafter, the sheet feed mechanism 1 is shifted to the first sheet feeding position, and the first and second sheet feed rollers 4 and 18 are driven to rotate in the counterclockwise direction. Thereby, an image of the second color is printed on the image of the first color. Further, an image of the third color is printed on the image of the second color by repeating a similar operation. Accordingly, a desired color image can be printed on the recording sheet 2.

In the above-described sheet feed mechanism 1 according to a preferred embodiment, before the front end portion 2*a* of the recording sheet 2 that is being conveyed downstream in the direction indicated by the arrow A by the second sheet feeding device P2 passes the first sheet feeding device P1 in which the pressure contact of the first pressure contact roller 5 is being released, and before the pressure contact of the second pressure contact roller 19 of the second sheet feeding device P2 with the recording sheet 2 is released, the pressure contact release mechanism P3 provided at the approximately center in the axial direction of the first pressure contact roller 5 is driven.

The first pressure contact roller 5 can be in pressure contact with the recording sheet 2 that is in the printing process and is being conveyed, with the pressure contact roller 5 kept parallel to the recording sheet 2. The pressure contact of the second pressure contact roller 19 can be released, with the second pressure contact roller 19 kept parallel to the recording sheet 2.

Therefore, the pressure contact of the first and second pressure contact rollers 5 and 19 with the recording sheet 2 which is being conveyed can be preformed and released, with each of the first and second pressure contact rollers 5 and 19 kept parallel to the recording sheet 2. Accordingly, a conveyance skew or the like can be prevented from occurring in the recording sheet 2 which is being conveyed.

In the embodiment described above, the pressure contact release mechanism P3 is provided at the side of the first sheet feeding device P1. Alternatively, the pressure contact release mechanism P3 may be provided at the side of the second sheet feeding device P2.

In the above-described embodiment, the extension coil spring is used to form each of the first and second resilient members 15 and 21 for causing the first and second pressure contact rollers 5 and 19 to be in pressure contact with the first and second sheet feed rollers 4 and 18, respectively. Alternatively, a compression coil spring may be used to form each of the first and second resilient members 15 and 21.

A sheet feed mechanism capable of performing highly accurate conveyance of a recording sheet without causing the oblique passage or the like by providing a pressure contact release mechanism at an approximately center in an axial direction of a pressure contact roller and by causing opposite ends in the axial direction of the pressure contact roller to be uniformly in pressure contact with a sheet feed roller is provided.

What is claimed is:

1. A sheet feed mechanism comprising:

sheet feeding means including a sheet feed roller that can rotate when driven, and a pressure contact roller capable of being in pressure contact with the sheet feed roller;

a recording sheet held in pressure contact between the sheet feed roller and the pressure contact roller and conveyed by rotation of the sheet feed roller;

printing means that print a desired image on the recording sheet;

a pressure contact release mechanism that can release the pressure contact of the pressure contact roller from the sheet feed roller for switching between a pressure contact state and a release state;

a drive shaft that extends in a direction parallel to the axial direction of the pressure contact roller, the drive shaft being provided for the sheet feeding means; and a drive source that can rotate the drive shaft by a predetermined angle, a connecting gear being rotatably connected to the drive source via a connecting shaft, wherein the pressure contact release mechanism includes the connecting gear and a drive gear that meshes either directly or indirectly with the connecting gear, the drive gear being rotatably provided on the drive shaft at substantially a center part thereof, and when the drive source rotates the connecting shaft, a driving power is transmitted via the connecting gear and the drive gear to the drive shaft so as to rotate the drive shaft by the predetermined angle, and as a result, the application of the pressure contact of the pressure contact roller to the sheet feed roller or the releasing of the pressure contact of the pressure contact roller from the sheet feed roller can be performed while the axial direction of the pressure contact roller being kept parallel to the recording sheet;

wherein the sheet feed roller can be driven to rotate, and the pressure contact roller can hold the recording sheet in pressure contact between the pressure contact roller and the sheet feed roller, and wherein the pressure contact roller is connected to the pressure contact release mechanism that can release the pressure contact of the pressure contact roller with the sheet feed roller, and the pressure contact release mechanism is provided near a center in an axial direction of the pressure contact roller.

2. The sheet feed mechanism according to claim 1, wherein the sheet feeding means includes a pair of roller support members that rotatably support opposite ends of a rotation shaft of the pressure contact roller, each of the pair of roller support members have one end formed with a roller support portion capable of rotatably supporting the rotation shaft of the pressure contact roller, and the other end resiliently biased by a resilient member, and wherein, through rotation of the drive shaft by the predetermined angle, the pressure contact release mechanism rotates the roller support member against biasing force of the resilient member, with a rotation support portion of the roller support member supported by a printer body and functions as a fulcrum, and causes the pressure contact roller to separate from the sheet feed roller by a predetermined distance.

3. A sheet feed mechanism comprising:

first sheet feeding means provided at a downstream position of printing means in a direction of conveying a recording sheet in a printing process, the first sheet feeding means includes a first sheet feed roller and a first pressure contact roller, and second sheet feeding means provided at an upstream position of the printing means in the direction of conveying the recording sheet, the second sheet feeding means includes a second sheet feed roller and a second pressure contact roller, a recording sheet held in pressure contact between the first sheet feed roller and the first pressure contact roller and conveyed by rotation of the first sheet feed roller, the recording sheet being held in pressure contact between the second sheet feed roller and the second pressure contact roller and conveyed by rotation of the second sheet feed roller;

the printing means printing a desired image on the recording sheet wherein either sheet feeding means further includes a drive shaft that extends parallel to the axial direction of the pressure contact roller, and a drive source that rotates the drive shaft by a predetermined angle;

wherein the first and second sheet feed roller can be driven to rotate, wherein the first pressure contact roller is connected to a pressure contact release mechanism that can release the pressure contact of the first pressure contact roller with the first sheet feed roller, and the pressure contact release mechanism is provided near a center in an axial direction of the first pressure contact roller, wherein the pressure contact release mechanism includes a connecting gear axially fastened to the drive source via a connecting shaft, and a drive gear in contact with the connecting gear and axially fastened to an approximately center of the drive shaft, wherein, when the connecting shaft is rotatable by the drive source, the drive shaft is rotatable by a predetermined angle via the connecting gear and the drive gear to enable release of the pressure contact of the first pressure contact roller with the first sheet feed roller, wherein opposite ends in an axial direction of the drive shaft support first drive links that can drive to rotate first roller support members of the first sheet feeding means, and second drive links that can drive to rotate second roller support members of the second sheet feeding means.

4. The sheet feed mechanism according to claim 3, wherein first and second cam members are axially fastened to opposite near-end portions in the axial direction of the drive shaft, and wherein the first cam members are rotatably fitted in corresponding first cam holes formed on the first drive links, and the second cam members are rotatably fitted in corresponding second cam holes formed on the second drive links.

5. The sheet feed mechanism according to claim 4, wherein each of the second drive links has one end formed with the second cam hole, and the other end formed with a second link support portion capable of rotatably supporting the other end of the corresponding second roller support member, and wherein, when the drive shaft is driven to rotate by the predetermined angle, the second cam members are rotated in the second cam holes, and the second roller support members are rotated via the second drive links, with second rotation support portions of the second roller support members functioning as fulcrums, so that the second pressure contact roller can contact and separate from the second sheet feed roller.

6. The sheet feed mechanism according to claim 4, wherein each of the first drive links has one end formed with the first cam hole, and the other end formed with a first link support portion capable of rotatably supporting the other end of the corresponding first roller support member, and wherein, when the drive shaft is driven to rotate by the predetermined angle, the first cam members are rotated in the first cam holes, and the first roller support members are rotated via the first drive links, with first rotation support portions of the first roller support members functioning as fulcrums, so that the first pressure contact roller can contact and separate from the first sheet feed roller.

7. The sheet feed mechanism according to claim 6, wherein, when the recording sheet is conveyed downstream while being nipped in pressure contact between the second sheet feed roller and the second pressure contact roller located at upstream positions of the printing means, the pressure contact of the first pressure contact roller with the first sheet feed roller is released, wherein, before a front end portion of the recording sheet that is being conveyed downstream passes between the first pressure contact roller and the first sheet feed roller which has been released from the pressure contact, and before the pressure contact of the second sheet feed roller and the second pressure contact roller with the recording sheet is released, the drive shaft is driven to rotate the second roller support members via the second drive links and release the pressure contact of the second pressure contact roller with the recording sheet that is being conveyed, and wherein the first roller support members are rotated via the first drive links, and the recording sheet that is being conveyed is conveyed downstream, with the first pressure contact roller being in pressure contact with the first sheet feed roller.

8. The sheet feed mechanism according to claim 7, wherein, when the first pressure contact roller causes the recording sheet to be in pressure contact with the first sheet feed roller, and when a rear end portion of the recording sheet in a printing process is released from the printing means, the first and second sheet feed rollers are driven to rotate in a reverse direction to feed the recording sheet back, wherein, before the front end portion of the recording sheet that is being fed back passes between the second pressure contact roller and the second sheet feed roller that is being released from the pressure contact, and before the pressure contact of the first sheet feed roller and the first pressure contact roller with the recording sheet is released, the drive shaft is driven to rotate the first roller support members via the first drive links and release the pressure contact of the first pressure contact roller with the recording sheet that is being fed back, and wherein the second roller support members are rotated via the second drive links, and the recording sheet that is being fed back is conveyed upstream, with the second pressure contact roller being in pressure contact with the second sheet feed roller.

9. The sheet feed mechanism according to claim 3, wherein the second pressure contact roller is connected to a second pressure contact release mechanism that can release the pressure contact of the second pressure contact roller with the second sheet feed roller, and that is provided near a center in an axial direction of the second pressure contact roller.

* * * * *

UNITED STATES PATENT AND TRADEMARK OFFICE

CERTIFICATE OF CORRECTION

PATENT NO. : 7,654,528 B2
APPLICATION NO. : 11/460192
DATED : February 2, 2010
INVENTOR(S) : Abe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 687 days.

Signed and Sealed this

Twenty-third Day of November, 2010

David J. Kappos

David J. Kappos
*Director of the United States Patent and Trademark Office*